United States Patent [19]

Courjaret et al.

[11] Patent Number: 4,701,094

[45] Date of Patent: Oct. 20, 1987

[54] SEPARATOR FOR HETEROGENOUS FLAT OBJECTS

[75] Inventors: François Courjaret, Paris; Gilbert Del Fabbro, Valence; Jean-Noël Devic, Cornas; Michel Divoux, Chateauneuf sur Isere; Guy Forella, Saint Peray; Jean-Pierre Hamant, Valence; Dominique Tubiana, Nanterre; Claude Pavie, Houilles, all of France

[73] Assignee: Compagnie Generale d'Automatisme CGA-HBS, Paris, France

[21] Appl. No.: 824,036

[22] Filed: Jan. 30, 1986

[30] Foreign Application Priority Data

Jan. 30, 1985 [FR] France ..... 85 01306

[51] Int. Cl.[4] ..... B65H 7/16

[52] U.S. Cl. ..... 414/330; 209/586; 209/900; 209/939; 221/13; 221/211; 271/11; 271/14; 271/98; 271/129; 271/132; 271/137; 414/121; 414/128; 414/225

[58] Field of Search ..... 209/586, 587, 598, 643, 209/900, 905, 939; 198/346, 370, 372, 438, 464.2, 468.4, 580; 221/13, 211; 271/4, 5, 11, 14, 31.1, 108, 97, 98, 104, 121, 125, 129, 132, 137; 358/107; 364/478, 479; 414/113, 121, 128, 131, 225, 730, 744 B, 330; 901/7, 40

[56] References Cited

U.S. PATENT DOCUMENTS

| | | | |
|---|---|---|---|
| 2,003,097 | 5/1935 | Vickery | 198/580 X |
| 2,294,273 | 8/1942 | Buxbaum | 271/5 |
| 2,636,591 | 4/1953 | Galper | 198/580 X |
| 2,988,355 | 6/1961 | Rabinow et al. | 271/31.1 X |
| 3,035,695 | 5/1962 | Buchwald et al. | 209/905 X |
| 3,193,281 | 7/1965 | Silsby, III et al. | 271/98 X |
| 3,201,114 | 8/1965 | Swartz et al. | 271/11 |
| 3,386,574 | 6/1968 | Kaplan | 271/5 X |
| 3,511,368 | 5/1970 | Kajitani et al. | 209/905 X |
| 3,617,048 | 11/1971 | Albert | 271/108 |
| 3,724,687 | 4/1973 | Marschke et al. | 414/121 |
| 3,804,270 | 4/1974 | Michaud et al. | 209/939 |
| 4,065,118 | 12/1977 | Dudley | 271/5 X |
| 4,167,227 | 9/1979 | Pichon et al. | 271/31.1 X |
| 4,236,710 | 12/1980 | Nakamura et al. | 198/468.4 X |
| 4,634,328 | 1/1987 | Carrell | 209/900 X |

FOREIGN PATENT DOCUMENTS

| | | | |
|---|---|---|---|
| 105782 | 4/1984 | European Pat. Off. | 209/900 |
| 1155716 | 10/1963 | Fed. Rep. of Germany . | |
| 1198283 | 8/1965 | Fed. Rep. of Germany . | |
| 1048767 | 2/1959 | France . | |
| 1369551 | 7/1963 | France . | |
| 2382387 | 9/1978 | France . | |
| 2546083 | 11/1984 | France | 209/657 |
| 52-75770 | 6/1977 | Japan | 414/121 |

*Primary Examiner*—Robert B. Reeves
*Assistant Examiner*—Edward M. Wacyra
*Attorney, Agent, or Firm*—Sughrue, Mion, Zinn, Macpeak, and Seas

[57] ABSTRACT

The article separator comprises at least one transfer station (20) receiving the articles to be transferred to the entrance of at least one delivery conveyor (4). Each transfer station is equipped with at least one pickup arm (21) with a suction head (22) at one end, driven between the transfer station and the delivery conveyor and having a plurality of orifices (23) which can be selectively connected to a vacuum source or a blown air source under the control of a video processing circuit (33) coupled to a camera (32) that registers the scene at the front of the transfer station. The separator can handle mail deemed to be non-mechanically-sortable hereto.

8 Claims, 11 Drawing Figures

SEPARATOR FOR HETEROGENOUS FLAT OBJECTS

The field of the present invention is that of the processing of flat objects and in particular of mail sorting. The invention specifically concerns the separation of various articles presenting among them a broad range of physical characteristics, which fall outside the range of mail sortable automatically by existing mail sorting machines.

BACKGROUND OF THE INVENTION

Such mail deemed to be non-mechanically sortable includes, for example, bulky letters, business and other "reply cards", magazines mailed with address bands or in plastic protective wrapping, same-address bulk mail and other types of mail, all of which generally come in bulk or loosely stacked in boxes or trays.

Whereas those articles making up the mechanically sortable mail category are processed automatically in separating machines enabling them to be picked one by one from a pile and sent to a mail sorting or distributing facility, those articles making up the non-mechanically-sortable category being the object of this invention are usually handpicked from the stock and manually sorted.

One example of such an installation for carrying out the ordering and individual pick-up of mechanically sortable mail articles is described in French patent document No. 2,382,387. In that installation groups of articles are inserted between moving feed means. The motion of the feed means jogs the articles against a backstop to align them by one of their edges and then conveys them to a distributing means. The distributing device, a rotary pick-up drum operating by means of a vacuum exerting pull through its perforated wall, picks up the articles one by one as the pins driving each set of articles before the drum are retracted.

It is the object of the present invention to enable automatic processing of mail hereto classified as non-mechanically-sortable.

SUMMARY OF THE INVENTION

The invention thus provides a separator or classifier for heterogenous flat objects comprising an article feed, hereinafter referred to as a letter feed, at least one delivery conveyor located some distance away from the letter feed, to convey the individual articles which it receives one after another, and a transfer station fed by the letter feed and provided with at least one pick off arm having a suction head with a perforated face, arranged substantially parallel to the broad faces of the said articles present in the transfer station, a drive motor for each arm, an instantaneous or "spot scene" imaging device for registering the scene at the front of the transfer station and a video processor coupled to said imaging device and controlling the relevant said motor and said suction head, wherein the said perforations or orifices of the suction head are selectively and alternatingly connected to a vacuum source and a blown air source via individual air lines equipped with means for selectively switching connections to one or the other air sources under the control of said video processor.

BRIEF DESCRIPTION OF THE DRAWINGS

The several features and advantages of the invention will be more readily understood in reading the following description with reference to the appended drawings in which.

DESCRIPTION OF THE PREFERRED EMBODIMENTS

The separator for variously-dimensioned flat objects according to the invention is intended to handle mail the individual items whereof exhibit very disparate physical characteristics, such as size, weight, stiffness, wrapping and so on, ie. very heterogenous mail not fitting into the category commonly considered to be mechanically sortable by existing high-speed mail sorting machines.

Figure 1:
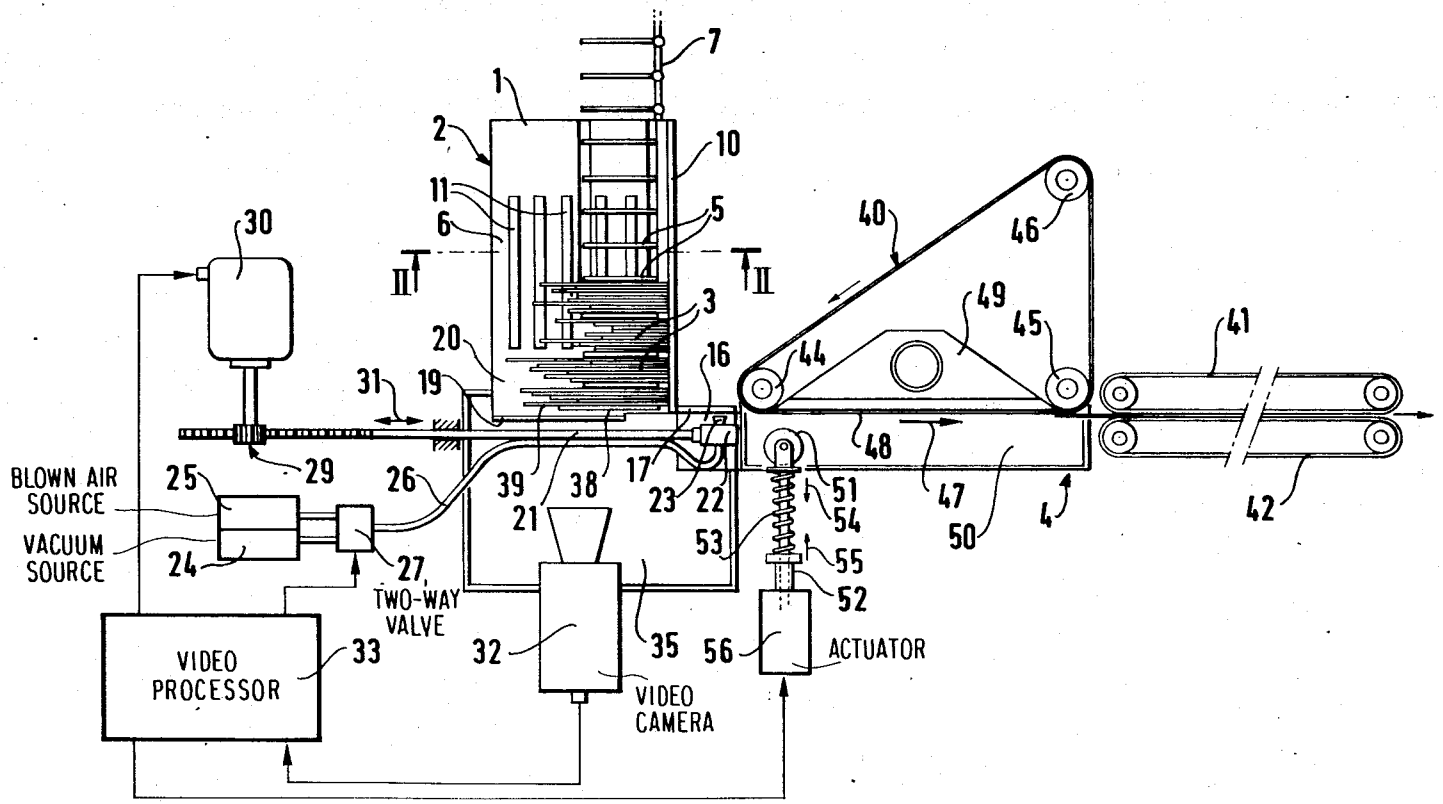
FIG. 1 is a top plan view of one embodiment of the article separator for "non-mechanically-sortable" mail in the process of handling mail stacked edgewise.

FIG. 1 shows just such a heterogenous mail separator working on a loosely organized stack of mail.

This separator or classifier consists of a letter feed 1, being in fact the terminal portion of a storage magazine 2 for a stack of articles 3, and a delivery conveyor 4, for conveying along the individual articles leaving the magazine 2.

The articles are stacked horizontally on their edges, with their bottom edges resting on the bottom of the magazine 2, which bottom is substantially horizontal and is located substantially in the same plane as the delivery conveyor 4.

Figure 2:
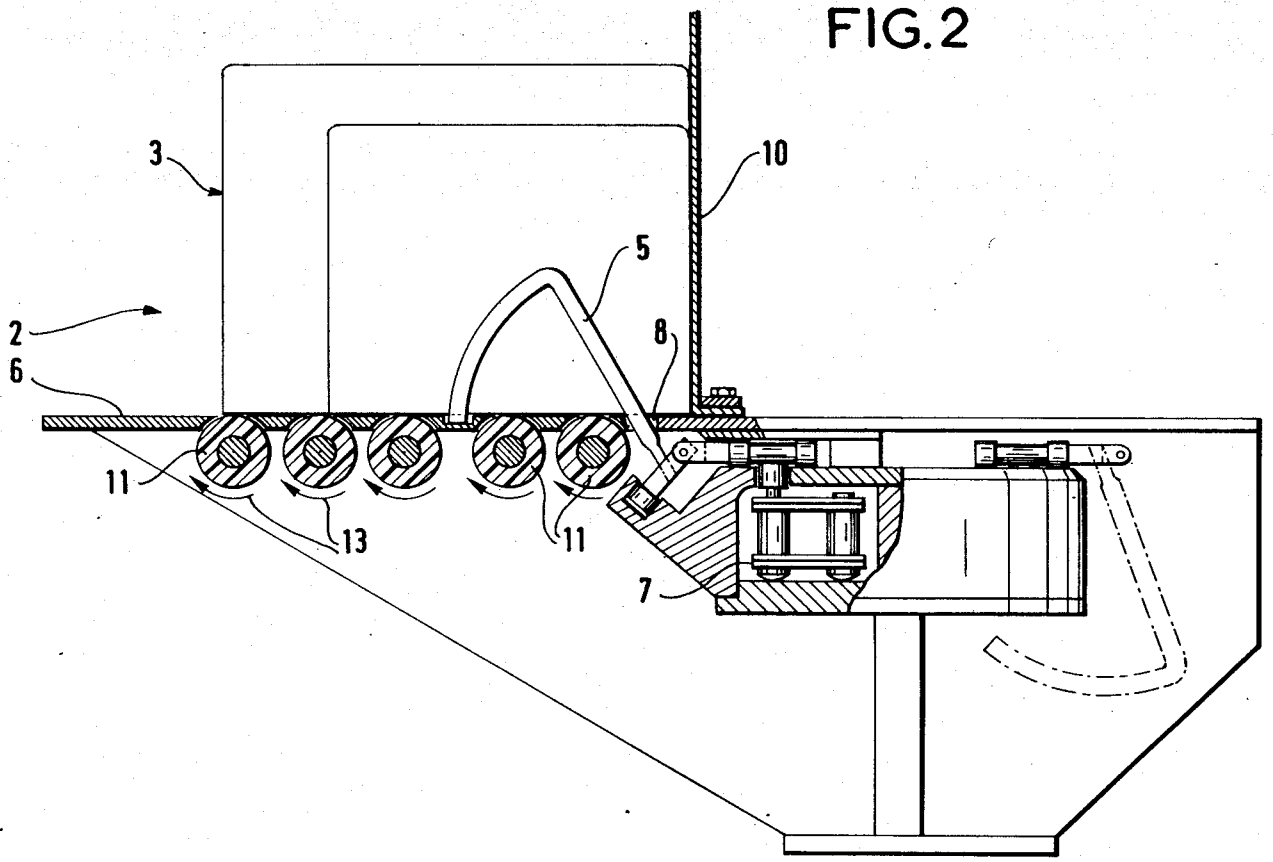
FIG. 2 is an elevation view of a system, known in intself, for presenting the stacked mail, included in the separator according to FIG. 1.

As can be clearly seen in this figure and even more clearly in FIG. 2, the magazine 2 is equipped with pusher fingers 5 which are driven along the length of the magazine, following a closed path defined by an endless chain 7 disposed beneath the bottom 6 of the magazine, the fingers being in fact mounted on said chain. The fingers are raised up vertically and project above the magazine bottom 6 through a slot 8, to push the articles through the magazine. They are retracted and folded down for the trip back to start of the magazine.

The magazine is also provided with a side wall 10 serving as a backstop for jogging the articles into approximate corner alignment. A set of rollers 11 is further installed beneath the bottom 6 of the magazine, with the axis of the rollers parallel to the long axis of the magazine and the set as a whole disposed in the middle section of the magazine. These rollers come flush with the inside surface of the magazine bottom, penetrating thereto through longitudinal slots in the bottom not specifically represented or labelled in the drawing. They are rotatively driven in the rotational sense indicated by the arrows in FIG. 2 (13), by means not shown, to jog the articles in middle section of the magazine against the magazine's side wall 10.

The equipment in the magazine 2 as well as the means of thrusting out and holding up the fingers in the magazine in order to push the articles along and the means for retracting the fingers at the end of the magazine for the return trip may for example be the same as those described in the above-mentioned document No. 2,382,387. As such, the magazine will not be further described in this specification.

In the mail classifier or separator illustrated in FIG. 1, the articles are inserted in batches between the fingers 5 at the letter feed 1. They are then conveyed to the opposite, terminal end or delivery end 20 of the magazine, and are aligned in passing through the middle section of the magazine, by jogging against the side wall 10, regardless of their position at the time of insertion. Thus the articles are substantially aligned against wall 10 by the time they reach the end 20 of the magazine.

The delivery end 20 is open toward the end of the magazine, facing the conveyor 4 some distance away. It constitutes the transfer station between the magazine 2 and the conveyor 4; this station for transfering articles from the magazine to the conveyor will therefore be designated hereinafter by the same number 20 as the delivery end of the magazine.

The fingers 5 retract in this transfer station to allow the articles to be picked off and transferred. Said delivery end 20 nevertheless is equipped with means to prevent the batch of articles that are being pushed to the end of the magazine by the fingers 5 falling over. Said upholding means consist merely of a raised or upturned edge 19 at the end of the delivery end 20, which provides a stop with a part of its length.

Also in this transfer station portion 20, the separator features a pickoff arm 21 with a substantially vertical, terminal suction head 22. The suction head 22 is shown in an intermediate, inactive position facing neither the transfer station nor the conveyor. In other words it is disposed in the illustrated embodiment to the side of the magazine, between the transfer station and the delivery conveyor, ahead of the side wall 10 of the magazine and spaced slightly apart therefrom. The suction head is provided on its face towards the articles with a plurality of orifices terminating in the shape of a suction cup 23. These orifices are individually connected to a vacuum source 24 or to a blown air source 25 by means of lines such as line 26. Each of these air lines 26 can be controllably switched to communicate with either of the sources 24 and 25, by means for example of a two-way valve 27.

The pick off arm 21 is coupled to a drive motor 30 by rack and pinion type transmission means 29 giving the arm, and thus also the head, a reciprocating translational motion, as indicated by the double arrow 31, crossing the axis of article feed in the magazine. In the course of this reciprocating translation of the arm, the suction head is brought from its inactive position to a pick off position facing the letters in the transfer station, then to a letter drop-off point substantially at the entrance to the delivery conveyor. Thereafter, it is returned to its initial, inactive position. The operation of the suction head will now be described in greater detail with reference to FIGS. 3 through 8.

To enable control of pick off arm 21 motion and of switching between the sources 24 and 25 for each of the orifices 23 of the suction head, a camera 32 registers the instantaneous or spot scene at the transfer station. This camera 32 is coupled to an image processor circuit or video processor 33 which effects the recognition of the outline of the article to be picked off from the head of the stack and accordingly actuates the arm drive motor and the depressurizing or pressurizing of the suction head orifices 23. Recognition of the outline of the head article in the transfer station is effected by the video processor 33 essentially on the basis of a differential treatment of the instantaneous image captured by the camera. The front of the transfer station is, to this end, advantageously illuminated by a conventional light source not shown in the drawing, disposed so as to accentuate the shadow projected onto the article next-in-line by the head article, when said head article is smaller than the next-in-line articles.

A reject receptacle 35 is provided beneath the transfer station 20 to receive any unacceptable articles. Unacceptable articles may be for example damaged articles; these are also detected by the camera and video processor system. Such articles are directly rejected at this stage into the receptacle 35 so that they will not be taken into account in the processing of the items transferred on the delivery conveyor 4.

The delivery conveyor 4 receiving the articles picked up by the suction head comprises, at its entrance, a substantially vertical vacuum belt 40. This belt 40 is followed by a pair of thin belts 41, 42 which snap up and transfer the articles received from the vacuum belt by squeezing them.

Said vacuum belt 40 is perforated substantially along its entire breadtha and is stretched around the three pulleys 44, 45 and 46 with substantially vertical axes. It is driven substantially continuously in the direction of arrow 47 by driving means not shown, coupled to at least one of the pulleys. The pulleys are disposed so that one side of the conveyor belt, termed the receiving side 48, lies substantially in the plane of the head article to be picked off the transfer station. A vacuum box 49 mounted on the inside of the conveyor applies the vacuum to the receiving side 48 of the belt 40.

A second receptacle 50 is disposed beneath the receiving side 48 of the belt 40, at the entrance to the delivery conveyor 4 to recover any double pick-ups made by the suction head 22, ie. in case another article is entrained with the desired article by adhering to its back.

To ensure correct pickup of the articles by the vacuum belt 40, a pressure roller 51 is provided next to the belt, to assist their pickup and adhesion to the receiving side 48 of the belt, especially as the suction head begins its return trip to initial position. This roller 51 is mounted in front of the side 48, at the end of a rod 52. It is urged to a withdrawn position from the belt by a tension spring 53 mounted captive around the rod and acting in the direction shown by the arrow 54. It is oppositely driven for engagement with the belt, according to the arrow 55, by an actuator 56, such as an electromagnet for example, coupled to the opposite end of the rod from the roller. The actuator, say an electromagnet, is moreover connected for own-control purposes to the video processor.

The actual pick-up or pick-off operation and the transfer of an individual article will now be described with reference to FIG. 1 and to FIGS. 3 through 8, which illustrate the basic steps of this operation carried out by the suction head under the control of the video processor 33 of FIG. 1. In the latter figures the numeral 38 is used to designate the head article to be picked off and transferred from the transfer station 20 to the vacuum belt 40. Said head article 38 has been purposely made smaller than the next-in-line article 39 in the given example.

Figure 3:
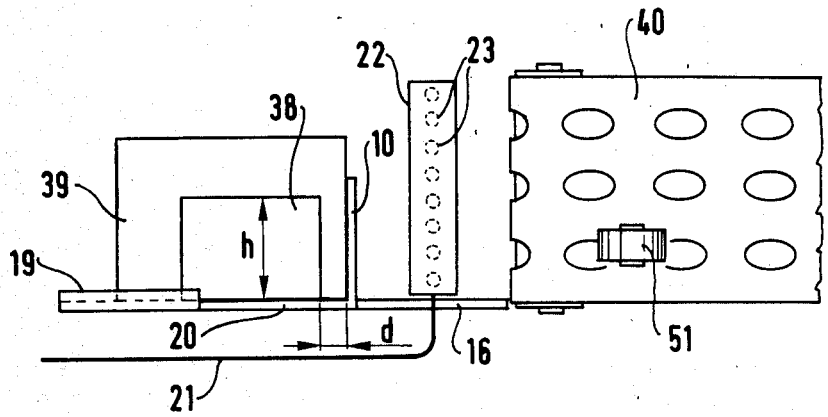
FIGS. 3 through 8 are elevational views which schematically illustrate the operation of the separator according to FIG. 1.

FIG. 3 shows the suction head 22 in inactive position between the transfer station 20 and the perforated vacuum belt 40. In this position of the head, the camera 32 has shot the scene at the front of the transfer station and transmitted the resulting image to the processing circuit 33. Said circuit 33 determines the dimensions of the head article 38, and in particular its height h. It also determines the the distance d between the edge of the article 38 and the side jogging wall 10, the jogging having failed to perfectly align said smaller article. The processing circuit consequently, as a first step, controls the motor 30 to drive the suction head 22 into position facing the article 38.

Figure 4:
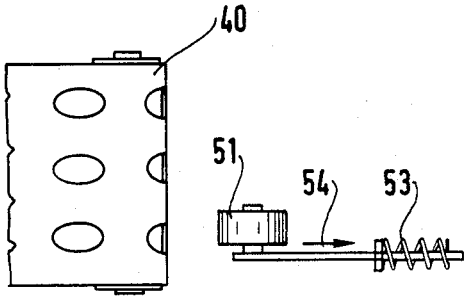

Simultaneously, as shown in FIG. 4, for the same inactive position of the head 22, the roller 51 is pulled back in the direction of the arrow 54 by the sole action of the spring 53 and is thus in retracted position relative to the belt 40. This retracted position of the roller makes for easier subsequent insertion of the article picked off by the head between the belt 40 and the roller.

Figure 5:
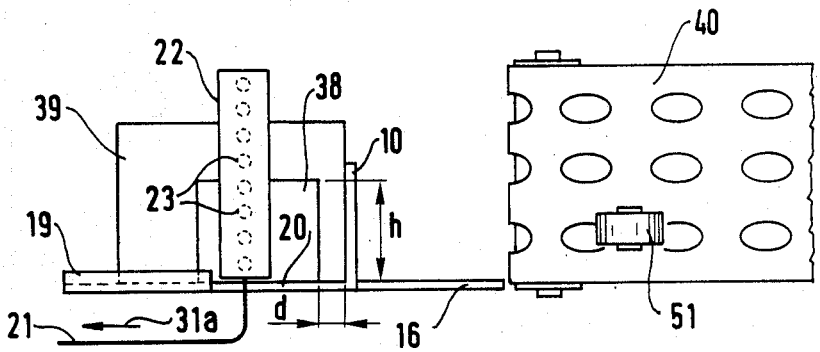

In FIG. 5, the head 22 has been driven in the direction of the arrow 31*a* and is located in front of the article 38; the detected distance d has for this purpose been used to give the number of additional drive steps required to position the head beyond the jogging wall and at the edge of article 38. As the head 22 stops in front of article 38, some of its orifices 23 are placed under vacuum and the others under pressure by connecting these orifices to one or the other of the suction or blowing sources 24, 25. The height h of article 38 detected by the processing circuit for this purpose is used to determine how many orifices at the bottom of the head should be connected to the vacuum source. The head article 38 thus adheres to the suction head, while the next-in-line article 39, which is larger, is blown back to ensure suitable separation of the articles 38 and 39.

Figure 6:
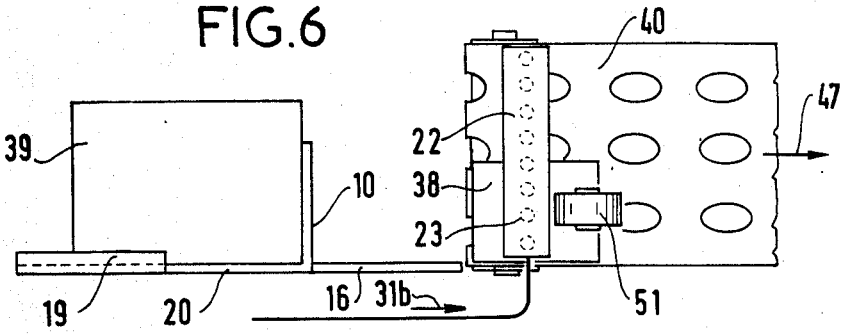

In FIG. 6, the suction head has moved in the direction of arrow 31*b*, carrying with it the article 38, which slides away from article 39 and along to the vacuum belt 40. The suction head is stopped slightly upstream from the contact or pressure roller 51, as the latter simultaneously is elastically applied against the belt 40, clamping the edge of article 38 there against.

Figure 7:
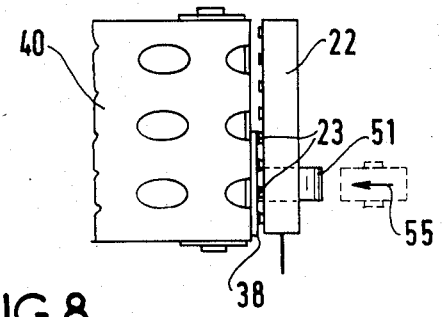

In FIG. 7, the roller's application against the belt is depicted, arrow 55 indicating the direction of application against the tension of the spring which normally maintains it in retracted position, the latter position being depicted with broken lines. This application of the roller to the belt 40 is performed by the electromagnet just as the article 38 meets the belt.

As soon as the article 38 is transferred to the belt 40 and is suitably applied thereto by the urging of contact roller 51, as shown in FIGS. 6 and 7, all of the orifices of the suction head are switched into communication solely with the blown air source. Alternatively, the entire set of suction head orifices can be cut off from the suction and blow sources by closing the connections between said orifices and said sources. Either or both of the latter actions bring about separation of the article from the head and promote a very good application of the article to the belt for the former's entrainment by said belt, which is itself being driven in the direction of arrow 47.

Figure 8:
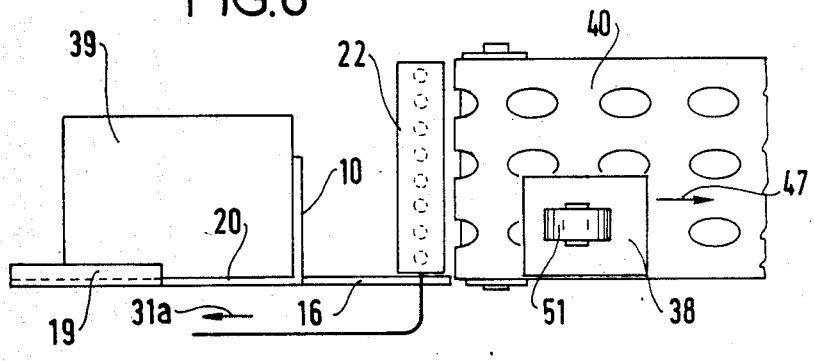

FIG. 8 shows this stage of the head's returning to inactive or neutral position, in the direction given by arrow 31*a*, as the article 38, maintained against the belt by the roller 51, is conveyed in the direction given by arrow 47 by said belt 40.

As the head returns to initial, inactive position, and specifically after the length of the article has slipped past the head, the contact roller is released. The latter then retracts, under the sole urging of the tension spring, from the facing belt.

The roller is maintained against the belt just long enough for the article to be taken in charge by the belt alone for conveyance to the conveyors 41, 42.

In the course of this transfer operation, the article is slidingly conveyed from the transfer station to the entrance of the delivery conveyor. Accordingly, a transition plate or "gangway" 16 (FIG. 1) is advantageously provided between the transfer station and the vacuum belt 40. This gangway is substantially at the same level as the bottom 6 of the magazine and presents a vertical stop 17 facing the suction head in inactive position and attached at a right angle to the end of the jogging side wall 10. The said conveyance by sliding of the transfer article avoids any need for high vacuums or air pressure at the head that might cause double pick-ups. Even so, supposing a double pick-up does occur, the centrifugal force developed by the vacuum belt acts to eject the article out of the two which is not in direct contact with the belt. An article ejected at this time is collected in the receptacle 50.

Figure 9:
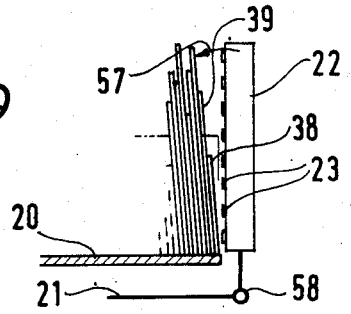
FIG. 9 shows an alternative arrangement of the separator device as illustrated in FIGS. 3–8.

FIG. 9 illustrates a variant of the arrangement depicted in FIG. 5 concerning the operation of the separator. The articles 38, 39 and following are slightly inclined from the vertical, their bottom edges being slightly ahead of their top edges in the transfer station. The articles can be made to so lean in the transfer station by known means omitted from the drawing, such as a suitable air jet for example, or belts in this portion of the magazine bottom, without altering the substantial horizontality of the magazine bottom. The suction head 22, as soon as it arrives in front of the article 38 to be transferred, is made to swivel as indicated by arrow 57 about an aritculation 58 on the end of the arm 21. It is thus applied to the article 38 for transfer of the latter.

The article 38 is then slidingly conveyed to the vacuum belt 40 by the head in this inclined position; the vacuum belt 40, the stop 17 or gangway 16 backstop (FIG. 1) and the conveyors 41, 42 can all be given the same inclination.

In an alternative construction not illustrated in the drawings, the device as a whole could be tilted from horizontal, sloping up from the back of the magazine to the transfer station 20, and the suction head 22, vacuum belt 40 and the pair of belts 41, 42 all tilted the same amount from the vertical. Such an arrangement would obviate the need for swivelling the head about the arm to apply it to the transfer article.

Figure 10:
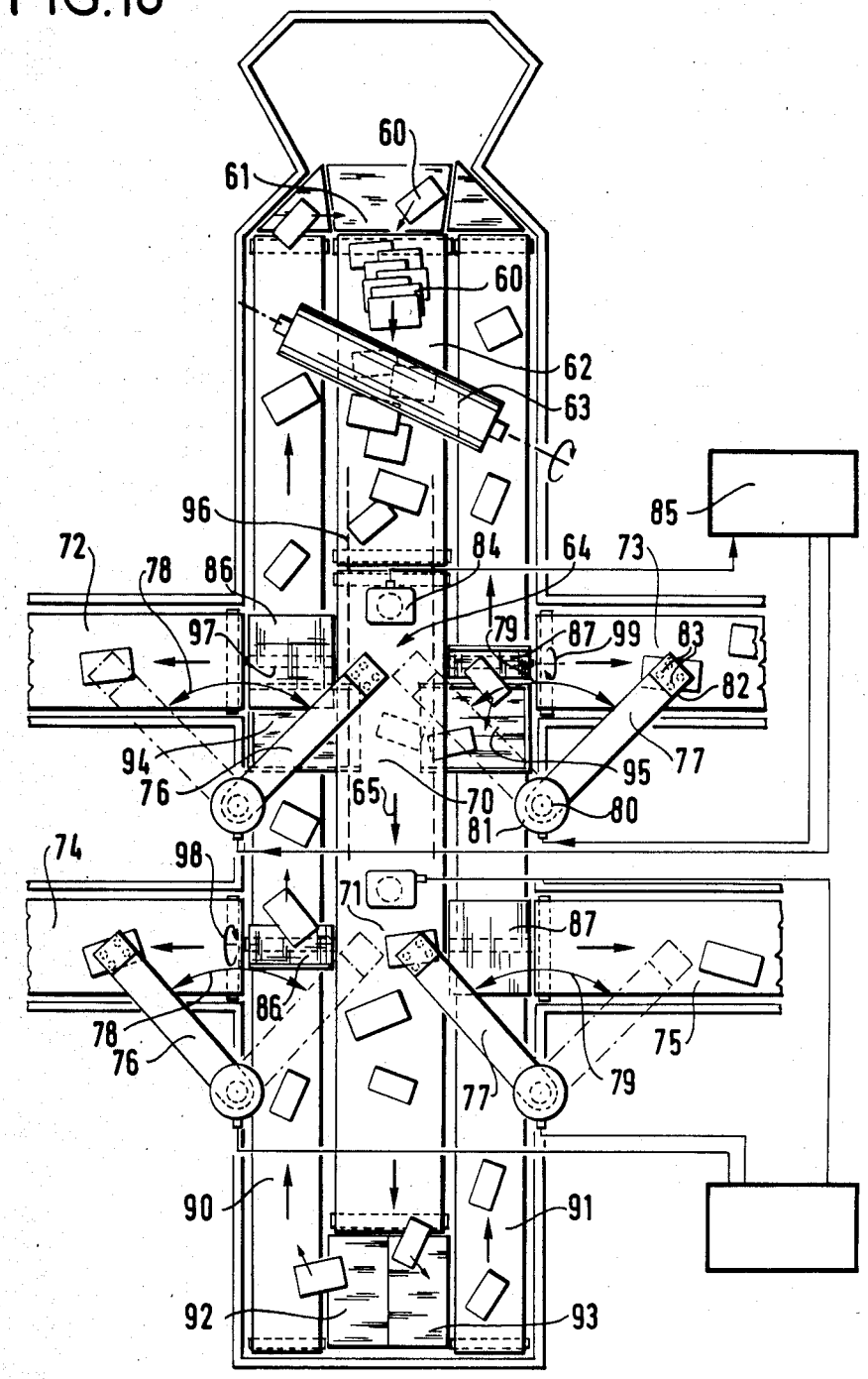
FIG. 10 is a top plan view of an alternative embodiment of the article separator according to the invention, handling letters laid down flat.

In FIG. 10 an alternative embodiment of the mail separator according to the invention is shown. In this embodiment the articles 60 are deposited in bulk or in loose stacks at the separator entrance station which consists of an entry ramp 61 followed by a sloping belt 62. The articles slide over one another and spread out along this belt 62. A roller 63 associated with the belt helps to spread the articles into a single layer.

A substantially horizontal conveyor, termed main conveyor, receives the articles directly from the belt 62 and conveys them in the direction of the arrow 65.

A plurality of transfer stations, two of which are illustrated and labelled by the numerals 70 and 71 in the drawing, are provided one after another in different sections of said main conveyor 64. Two delivery conveyors are provided for each transfer station, namely delivery conveyors 72 and 73 for station 70 and 74 and 75 for station 71 in the drawing. These two delivery conveyors per transfer station can be independent of one another or form the entrances to a shared conveyor not illustrated. They are located to either side of a transfer station and substantially in the same plane as the main conveyor 64.

Each of the transfer stations is similarly equipped, as will be detailed now with reference to transfer station 70. Said transfer station equipment includes two article pick-up arms 76, 77 both operating with a reciprocating rotary motion, on a fixed path, according to the double arrows 78 and 79 for the two said arms. One end of each arm, such as of arm 77 for example, is offset from the edge of main conveyor 64 and is coupled to a drive shaft 80 that is itself coupled to a driving motor 81. The other end of said arm terminates in a suction head 82 having a plurality of orifices shaped like suction cups 83, opened toward the conveyors 64, 73. The orifices of the suction head 82 are individually, selectively connected to a suction and a blown air source omitted from FIG. 10, but analogous to those of FIG. 1, via air lines in the arm. Said suction and blown air sources apply a vacuum or compressed air to the orifices to pick up or drop off an article. When said arms are in neutral or inactive position, their suction heads are located above the relevant transfer station but are external thereto since they are not in contact with the articles. However, when one of the arms is actuated, its suction head drops down a few centimeters to the conveyor 64 to pick up an article present on the conveyor. The aspirated article then accompanies the said head along its path to the delivery conveyor. It is then dropped onto the delivery conveyor and the head is returned to its initial position corresponding to the arm's neutral position.

Alternatively the reciprocating rotary motion of each arm can be replaced by a full rotary motion and the arms stopped on reaching their initial position after each drop-off of an article.

The arm 76 equipping this transfer station 70, and the arms equipping the other transfer station 71 are identical to arm 77, as is their operation; they therefore need not be individually described.

In view of actuating the drive motor of each arm equipping each of the transfer stations and of selectively connecting the orifices of the arm's suction head with the vacuum and blown air sources, a camera shoots the instantaneous scene at the front of the transfer station, said camera being identified by the numberal 84 in transfer station 70. The imaged scene concerns the two pickup arms of the transfer station. An image processing circuit 85 coupled to the camera analyzes the picture and recognizes or locates the articles arriving at the transfer station 70 and possibly concerning one or the other of the arms at meeting times between each of said articles and each of said heads. The circuit consequently controls the said arms, actuating them, applying suction or pressure to the orifices of their heads, then interrupting the connections between said orifices and said sources at the appropriate times, or at least breaking the connection with the vacuum source as the transferred article arrives over the delivery conveyor. Identical image processing of the picture from the front of transfer station 71 enables control of each of the arms at this station at the appropriate times.

In the embodiment illustrated in FIG. 10, there are gaps between each of the delivery conveyors 72, 73, 74, 75 and the main conveyor at the transfer stations. Each gap is normally closed by a trap, 86 or 87 according to the side considered, these traps being disposed slightly below the level of the main conveyor 64 and of the delivery conveyors. The traps collect any drop-offs as may occur from double pick-ups or any unacceptable articles picked up by the suction heads. Two recycling conveyors 90, 91 are disposed in the gaps between the main conveyor and the delivery conveyors, running beneath the traps. They are linked with the main conveyor 64 by means of inclines 92, 93 enabling articles having gone through the successive transfer stations without being picked up and transferred to slide down onto one of the recycling conveyors for conveyance and refeeding to the entrance ramp 61 into which the recycling conveyors merge.

In these same gaps between the main conveyor 64 and the delivery conveyors, at an intermediate level between the level of the traps and that of the recycling conveyors, issue ramps, termed ejection ramps, such as those designated by the numerals 94 and 95, to one side of the traps 86 and 87 associated with transfer station 70. These ejection ramps terminate on an ejection conveyor 96 under the main conveyor 64 and suggested with broken lines in the drawing. Identical ejection ramps are provided next to the traps of the transfer station 71 but have been omitted from the drawing.

The traps are operable to swivel either way about a shaft such as that labelled 97 in trap 86 for the purpose of recycling drop-offs from double pickups or evacuating unacceptable articles. When they swivel in the sense indicated by arrow 98 drawn for one of the traps 86, the traps drop the articles they have collected onto the recycling conveyor. When they swivel the opposite way, according to arrow 99 for trap 87, they drop their collected articles onto their associated ejection ramps. The corresponding command to segregate the articles for transfer to the delivery conveyors from those to be rejected is given by the processing circuit, based upon the picture taken by the camera. This command is transmitted to a motor actuating each of the traps, which has been omitted from the drawing for the sake of clarity. This control system also cuts the connection between the vacuum source and the head orifices so that the rejected articles are released onto the trap doors.

Within each transfer station 70 and 71, the operation of the separator according to FIG. 10 is comparable to that of the separator of FIG. 1, the rotative or arcuate drive of each arm in the present case being adapted to the handling of articles laid down flat, whereas in the embodiment of FIG. 1 the articles are fed in upright or on edge. In both cases the arms make the articles slide from the transfer station to the corresponding delivery conveyors. In the embodiment according to FIG. 10 each transfer station has two article pickup arms and several transfer stations are installed in a line. This arrangement enables a high separating or classifying rate without a very fast pickup cycle.

Figure 11:
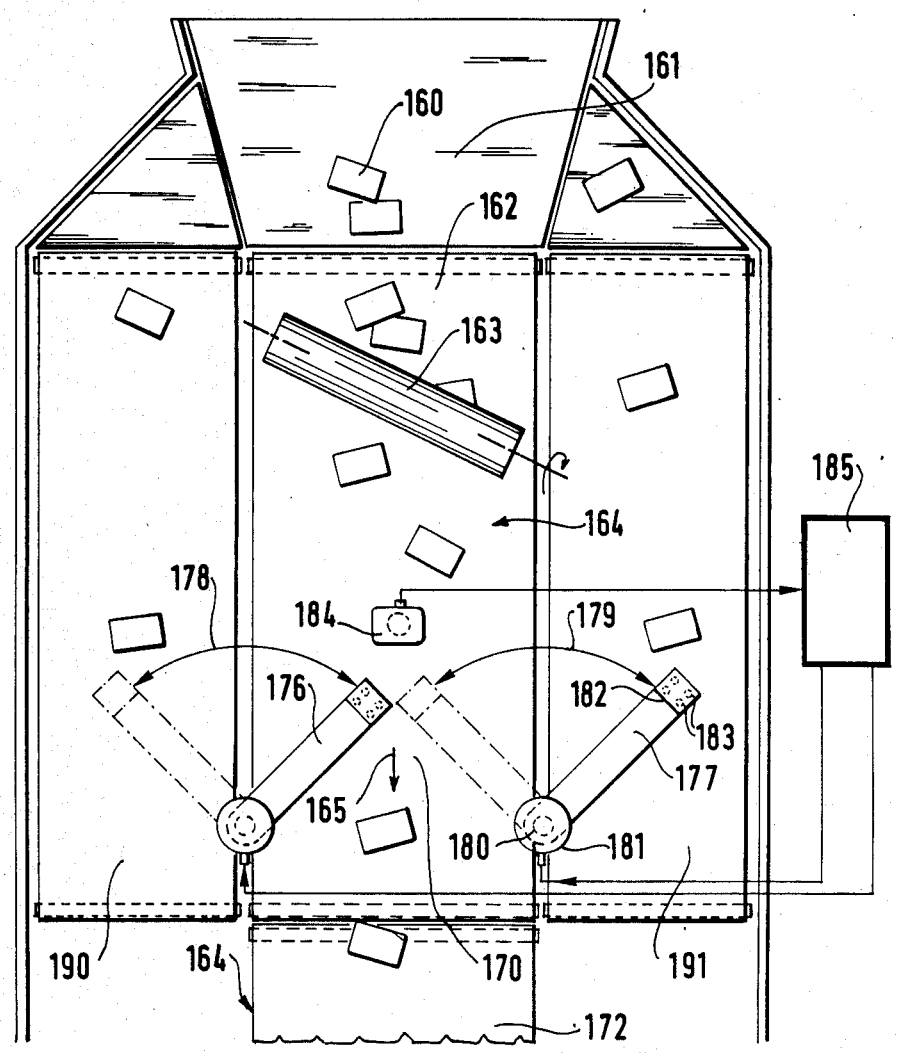
FIG. 11 is a top view of a variant of the embodiment illustrated in FIG. 10.

FIG. 11 shows another variant of the separator according to the invention, derived from the embodiment according to FIG. 10. To enable a more summary description, comparable items in the two figures bear the same references, except that those in FIG. 11 are numbered in the hundreds.

Thus the letter feed 160 receiving the articles in bulk includes an entry ramp 161 followed by a sloping belt conveyor 162 with a spreading roller 163. A substantially horizontal main conveyor 164 receives the articles leaving the belt 162 and conveys them according to arrow 165.

A transfer station 170 is set up on the entrance section of the main conveyor receiving the articles from the sloping belt 162. Said transfer station 170 is provided with two article pickup arms 176, 177. The two arms are imparted a reciprocating arcuate motion according to the arrows 178 and 179 under the control of a motor such as 181 coupled to one of their ends, at the edges of the conveyor 164. The other end of the arms forms a suctiom head 182 having orifices 183 opened toward the conveyor on the one hand and connected on the other hand to a vacuum source and a blown air source, both omitted from the drawing, giving the suction head an article pickup capability.

A camera 184 at the front of the transfer station provides images of the instantaneous scene and a video processing circuit 185 coupled to the camera trips the arm drive and the suction heads into operation.

In the variant of FIG. 11, the main conveyor constitutes, downstream from the transfer station 170, the entrance to a sole delivery conveyor for separated articles, and two belts 190, 191 on the other hand disposed to either side of said main conveyor serve to recycle articles picked up from the main conveyor by the arms at the transfer station to the entry ramp 162. The entrance of the sole delivery conveyor is designated by the numeral 172, designating the portion of the main conveyor 164 downstream from the transfer station, by analogy with the reference 72 designating one of the delivery conveyors for separated articles serving transfer station 70 in FIG. 10.

It should be readily apparent that in the presently considered arrangement the arms and their suction heads are controlled to leave on the main/delivery conveyor beyond the transfer station only articles having been duly separated from one another. Consequently, they effect the transfers of articles appearing more or less superposed in the said transfer station, as detected by the camera. In neutral position with the heads raised above the transfer station and therefore external thereto since they are not in contact with the articles, the arms allow the articles to pass unhindered. Upon detection of a double article, the video processor 185 commands the actuation of the arm concerned by the detected double article; the head descends a few centimeters toward the conveyor belt 164, to meet the double article; some of its orifices are imparted a vacuum and others an air pressure; and the head is then driven from the transfer station to the recycling conveyor 190 or 191 located on its own side of the main conveyor. Accordingly, the head sucks up at least one of the articles of the detected double article, which so aspirated accompanies the head as far as the recycling conveyor, where it is dropped. The suction head thereafter immediately is returned to initial position.

Obviously, though not so illustrated, a trap for unacceptable articles detected by the camera just like one of the traps provided in the embodiment of FIG. 10 can be included between the transfer station 170 of the main conveyor 164 and each recyling conveyor 190, 191. Likewise, a plurality of identical transfer stations can be provided along the main conveyor 164, upstream from its portion 172 constituting the entrance to the delivery conveyor. The latter disposition advantageously enables a cascaded check of the articles transported on the conveyor so that only separated articles will reach the conveyor transition area 172.

It is desired that the foregoing description made with reference to the embodiments specifically illustrated in the accompanying drawings not be construed as limiting the scope of the invention, since various modifications to details of the invention and substitutions of certain of the means by technically equivalent means will obviously occur to those familiar with the art. Also, the separator according to the invention as defined by the following claims can be used not only for mail sorting, but also for the sorting of flat objects in general, for the classification of orders for delivery or for automatically feeding production lines.

What is claimed is:

1. A separator for heterogenous flat individual articles having broad faces, said separator comprising: an article feed, at least one delivery conveyor located some distance away from the feed to convey the individual articles which it receives sequentially, one after another, and a transfer station supplied with said articles from the article feed and provided with at least one pickup arm having a suction head with a plurality of orifices on one face substantially parallel to the broad faces of the articles present in the transfer station, a vacuum source, a blown air source, a drive motor for said at least one arm, a video imaging device to register the instantaneous scene at the transfer station and a video processor coupled to said imaging device and controlling the said at least one arm, means for selectively connecting said orifices of the suction head to said vacuum source and said blown air source via individual air lines equipped with means for selectively switching connections to one or the other of said sources under the control of said video processor.

2. A separator according to claim 1, wherein said article feed comprises a magazine, said transfer station is constituted by the delivery end of said magazine, said delivery end is equipped with retractable fingers for pushing along and holding said articles on their edges, said delivery end of the magazine being substantially aligned with the entrance of said at least one delivery conveyor, said at least one delivery conveyor being a single delivery conveyor, and wherein said at least one pickup arm is coupled to said drive motor by means imparting a reciprocating translational motion to its head, crosswise to the advance of articles in the magazine, moving the head from a neutral position in which it is external to the transfer station to a pickup position in which it is within the transfer station, then to a transfer position in which it is located substantially in the entrance to the delivery conveyor, and thereafter returning to the neutral position.

3. An article separator according to claim 2, wherein said neutral position of the head is established between said transfer station and said delivery conveyor.

4. An article separator according to claim 3, wherein the entrance to the delivery conveyor consists of a vacuum belt having an article receiving side substantially transverse to the magazine at the level of said transfer station.

5. Separator according to claim 4, wherein said vacuum belt cooperates with a retractable contact roller controlled by said video processor.

6. Separator according to claim 1, wherein the transfer station is a section of a main conveyor, said main conveyor comprises means for transporting said articles laid down flat, said at least one pickup arm comprises plural pickup arms, each of said plural pickup arms is mounted at the edge of said main conveyor to pivot above the same to transfer each said article picked up to the entrance of the at least one delivery conveyor formed beside said transfer section of the main conveyor, said separator further includes an article recycling conveyor, an article ejection ramp, and between said transfer station and said at least one delivery conveyor, a trap, means mounting said trap for swiveling in two ways; one way to communicate with said article recycling conveyor and the other way to communicate with said article ejection ramp, and wherein said article recycling conveyor and said article ejection ramp are disposed at different levels beneath the trap.

7. Separator according to claim 6, wherein an end of said main conveyor and said recycling conveyor are joined together by an incline.

8. Separator according to claim 1, wherein the transfer station is a section of a main conveyor, said main conveyor comprising means for transporting said articles laid down flat, said at least one pickup arm comprises plural pickup arms, and each of said plural pickup arms is mounted at the edge of said main conveyor to pivot above and across the same, wherein said separator further comprises a single delivery conveyor having an article receiving entrance constituted by said main conveyor downstream from said transfer station and at least one recycling belt for transporting articles to the article feed after receiving them from the pickup arms at the transfer station.

* * * * *